United States Patent [19]

Carter

[11] 3,988,020

[45] Oct. 26, 1976

[54] SWIMMING EXERCISE AND TRAINING APPARATUS

[76] Inventor: James R. Carter, 1601 Lyle Drive, San Jose, Calif. 95129

[22] Filed: Sept. 8, 1975

[21] Appl. No.: 611,144

[52] U.S. Cl. ..... 272/125; 272/71; 272/143

[51] Int. Cl.[2] ..... A63B 69/12

[58] Field of Search ..... 9/310 J, 301, 311, 329, 9/336; 35/29 B; 272/1 B, 57 R, 71, 125, 143

[56] References Cited

UNITED STATES PATENTS

| | | | |
|---|---|---|---|
| 2,825,224 | 3/1958 | Lindenauer et al. | 35/29 B |
| 3,226,114 | 12/1965 | Swider | 35/29 B |
| 3,512,416 | 5/1970 | Hohwart | 272/71 |
| 3,724,012 | 4/1973 | Sanderson | 272/71 |
| 3,751,031 | 8/1973 | Yamauchi | 272/57 R |

FOREIGN PATENTS OR APPLICATIONS

| | | | |
|---|---|---|---|
| 765,717 | 8/1967 | Canada | 272/71 |
| 675,917 | 2/1930 | France | 9/336 |
| 1,190,849 | 4/1965 | Germany | 272/71 |

*Primary Examiner*—Trygve M. Blix
*Assistant Examiner*—Jesus D. Sotela
*Attorney, Agent, or Firm*—Richard Alan Brown

[57] ABSTRACT

A swimming exercise and training apparatus capable of use by the swimmer in water at the side of a pool and allowing the swimmer to remain at a fixed distance from the side of the pool. The device preferably includes at least two flexible lines, the second end of each line is attached to an anchoring structure at the side of the pool or the like and the first end of each line is attached to a belt which is disposed above and encircles the waist of the swimmer, and attached to the belt is a plurality of pads with a plurality of straps attached to each pad for securing the position of the belt about the waist of the swimmer and for securing the position of the first end of each line.

3 Claims, 6 Drawing Figures

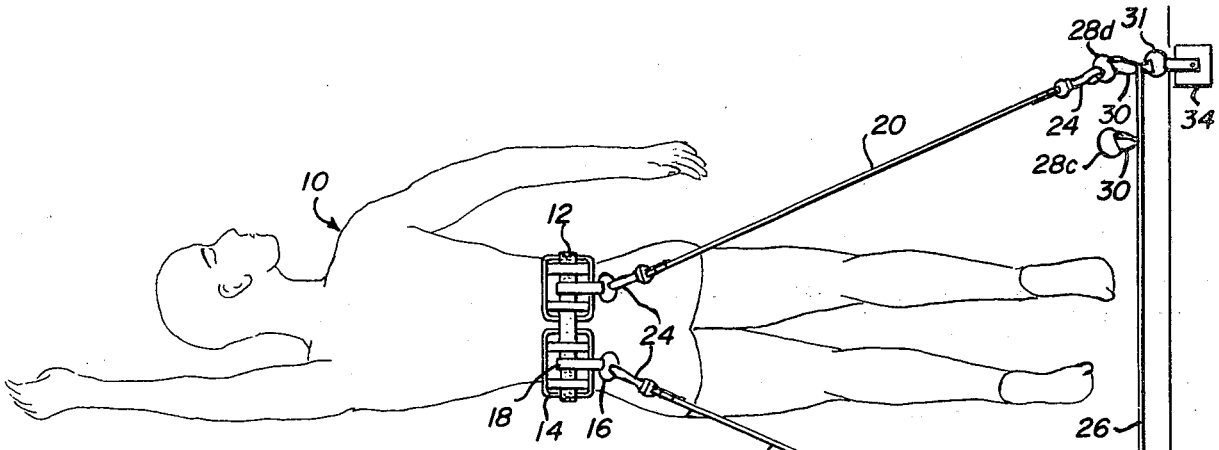
Fig_1
Fig_5
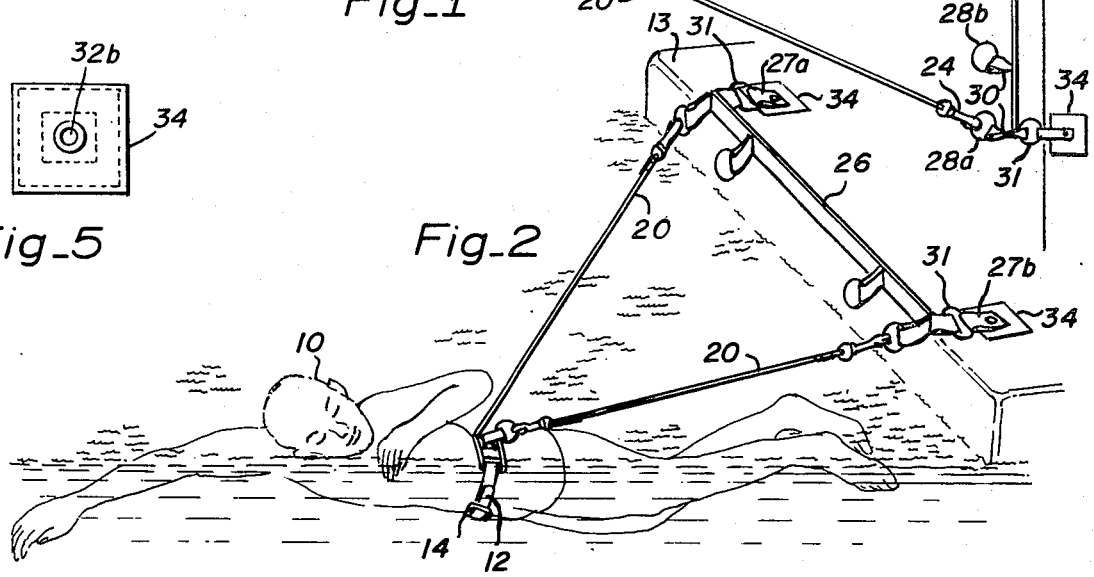
Fig_2
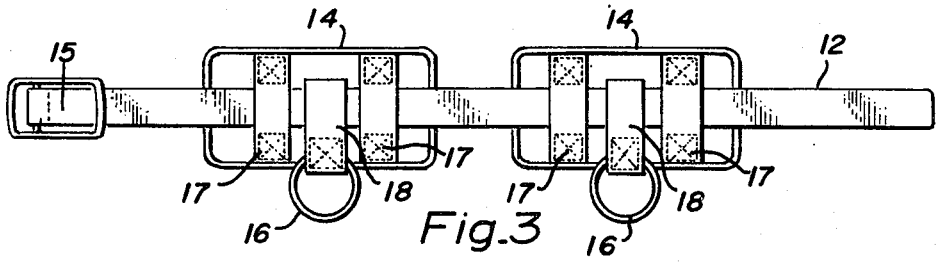
Fig_3
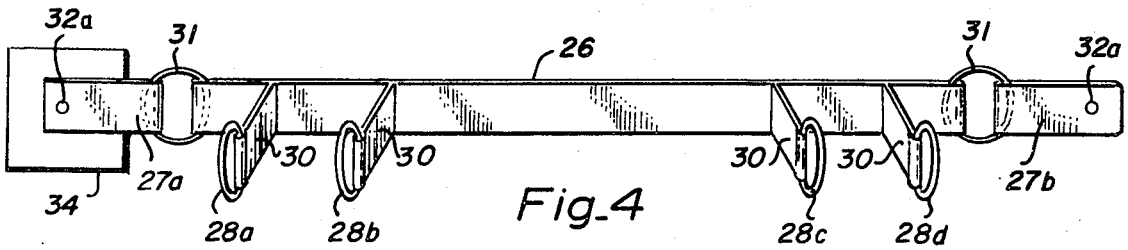
Fig_4
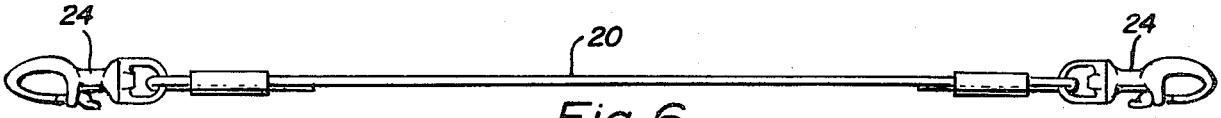
Fig_6

SWIMMING EXERCISE AND TRAINING APPARATUS

BACKGROUND OF THE INVENTION

1. FIELD OF THE INVENTION

The invention generally relates to training aids and exercising aids for swimmers and, in particular, to certain new and useful improvements wherein a swimmer using the device can exercise or develop swimming techniques in a relatively small swimming area.

2. DESCRIPTION OF THE PRIOR ART

In the past swimming instructors have walked alongside the edge of the pool and observed swimmers exercising, learning or practicing various swimming strokes. The disadvantage of this is the instructor has difficulty in both observation of and communication with the student as neither the instructor nor the student are stationary. Further, in the past, when neither the instructor nor the student were stationary, control problems were created for the instructor when giving instructions to a group of swimmers. Still further, in the past an individual swimmer in order to receive maximum benefit in swimming exercise and training situations needed a large swimming area in which to practice or otherwise develop swimming rhythm, speed and endurance without the necessity of having to turn and change direction repeatedly, as is the case in a small pool.

Recently, devices have been proposed that include a ring disosed about the waist of the swimmer and the ring suspended from a frame to support the swimmer while using the device. An example of such device is disclosed in U.S. Pat. No. 3,512,416 by G. HOHWART for swimming apparatus. This device, as it supports the swimmer, creates an artificial swimming and training enviroment for the swimmer. Also, the device is cumbersome and bulky in use and when in position at the edge of the pool creates an obstacle to others who are in and about the pool area.

Another type of aquatic device has been proposed such as U.S. Pat. No. 3,724,012 by P. E. SANDERSON for aquatic device. This patent discloses a support for the head of the swimmer rather than the entire body. This device, as with other previously proposed devices provides an artificial support for the swimmer while the swimmer exercises or trains as it creates a head rest for the swimmer. Also, this recently proposed device is permanently anchored to the side of the pool and creates an obstacle to others who are in and about the pool area.

SUMMARY OF THE INVENTION

The aquatic apparatus of the present invention overcomes and mitigates the disadvantages of the above-described prior art in that the present invention discloses a swimming exercise or training apparatus for use in a swimming pool or the like which comprises a belt disposed about and encircling the waist of the swimmer, the belt having coupled thereto a plurality of rings, means coupled to the belt for securing the position of the belt about the waist of the swimmer and for securing the position of the rings which are coupled to the belt, at least two lines, each of which includes attaching means at the first and second ends thereof, with the first ends thereof attached to the rings coupled to the belt, and further includes means for attaching the second ends of the lines to the edge of a swimming pool.

Thus, an advantage of the present invention is to provide a swimming exercise and training apparatus that does not, in the preferred embodiment, artificially support the swimmer.

Another advantage of the present invention is to provide a simple non-cumbersome and non-bulky device that is portable, need not be permanently anchored to the side of the pool or create an obstacle for others in and about the pool area.

A further and no less important advantage of the present invention is to allow the plurality of lines attached to the belt and the anchor means to be easily adjusted to swimmers of various height.

A still further advantage of the invention is to provide a device that can be used in a small swimming area, such as a home pool, and yet allow the swimmer to practice all swimming strokes for whatever period, thereby developing rhythm and endurance without having to turn repeatedly and change direction.

A further advantage of the invention is to allow the swimming instructor better observation of and communication with the student swimmer as both can remain at a fixed distance from the other.

Yet a further advantage of the invention is to provide a simple aquatic apparatus capable of use by swimmers of all age groups with widely varying degrees of proficiency in swimming from the untrained novice through the professional swimmer.

BRIEF DESCRIPTION OF THE DRAWINGS

In the drawings, forming a part of the specification, and wherein like reference numerals are employed to designate like parts throughout the same:

FIG. 1 is a horizontal view of the silhouette of a swimmer with the aquatic appartus constructed with the principals of the invention and showing how it is constructed and preferably used.

FIG. 2 is a view in perspective of the silhouette of a swimmer with the aquatic apparatus constructed with the principals of the invention and showing how it is constructed and preferably used.

FIG. 3 is a horizontal view of a component unit that is disposed about the waist of the swimmer.

FIG. 4 is a verticle view of the inner facing unit between the anchoring means and the lines attached to the swimmer's belt means.

FIG. 5 is a horizontal view of the component unit of tank anchor means.

FIG. 6 is a verticle view of the component unit to be coupled to the swimmer's belt means and to be coupled to the tank anchor means

DETAILED DESCRIPTION

Referring now to FIGS. 1 and 2 a swimmer 10 is illustrated in a pool having an edge 13 thereof. Swimmer 10 has disposed about his waist a belt 12, which may preferably be made from a non-bouyant material such as nylon, but it is recognized other flexible materials are suitable. The belt 12 has a buckle 15 or other latching device attached thereto.

Referring now to FIGS. 1, 2 and 3 views of the two belt positioning means 14 are shown, the belt positioning means 14 shall hereinafter be referred to as pads 14 and said pads 14 may preferably be made of non-bouyant material such as cloth, plastic, rubber or the like. Attached to each pad 14 is at least two flexible straps 17 or the like. The first and second end of each strap 17 are secured to the side of the pad 14 that does not directly contact the body of the swimmer 10. Belt 12 is coupled to pads 14 by disposing said belt 12 between pads 14 and the strap 17 or the like.

In using the training and exercising device for the present invention, the pads 14 are disposed about the sides of the waist of the swimmer 10. Thus, the pads 14 aid in retaining the belt 12 in position about the waist of the swimmer and aid in preventing said belt from chaffing or otherwise injuring the sides of said swimmer.

In one embodiment the belt 12 has coupled thereto a plurality of flexible straps 18 or the like. Each strap 18 or the like has flexibly attached thereto at least one ring 16 (e.g., the straps 18 are formed into a closed loop after passing said strap through the eyelet of a ring 16). The straps 18 are coupled to the belt 12 so that the two straps 17 of the belt securing means 14 are adjacent to and on opposite sides of the strap 18 when the belt securing means 14 is coupled to said belt. Thus, in one embodiment, the rings 16 are positioned at each side of the swimmer 10 to insure the lines 20 neither interfere with the limbs of said swimmer, nor become positioned as to create control problems for said swimmer in maintaining his swimming direction away from the anchoring device attached to the edge of the pool.

Referring now to FIG. 6 a flexible line 20 is shown which may preferably be made of nylon, but other materials are suitable. Line 20 has attached at the first and second ends thereof swivel hooks 24 or the like. In particular, swivel hooks 24 are attached to each end of the line 20 to enable flexibility of use of the device in the present invention. In using the present invention FIGS. 1 and 2 illustrate a preferred embodiment wherein the first ends of lines 20 are attached to the rings 16 and the second ends of said line are attached to a belt 26 or the like by means of rings 28 or the like.

Referring now to FIG. 4 a flexible belt 26 or the like is shown. The flexible belt 26 or the like may preferably be constructed of nylon, but it is recognized other suitable materials may be used. Further, it is recognized the second ends of the lines 20 may be attached to the anchoring means at the side of the pool without use of the belt 26. The belt 26 is attached between adjacent anchoring means 27*a* and 27*b* by rings 31. The anchor means 27*a* and 27*b* contain snaps 32*a* or the like and it is recognized that other types of anchoring means are satisfactory. The snaps 32*a*, or the like, are attached to the anchoring device 34 or the like which is shown in FIG. 5. In one embodiment the anchoring means 34 consist of a flexible pad, or the like, with attached thereto snaps 32*b* or the like to the edge of the swimming tank 13. Also, the belt 26, in one embodiment, has attached thereto a plurality of ring retaining means 30. The ring retaining means 30 has flexibly attached thereto a plurality of rings 28. The rings 28 are flexibly disposed on the means 30 at various distances along the belt 26 to enable coupling of the swivel hooks 24 at various distances as required by the swimmer 10. The rings 28 are disposed at various distances along the belt 26 to enable connections of belt 26 at various widths, depending upon the size of the swimmer 10. That is, for example, the swivel hooks 24 would be attached to rings 28*a* and 28*d* for a smaller swimmer 10.

In one embodiment it was found that a length of six feet for lines 20 was desirable for most swimmers. Also, in accordance with the preferred embodiment, the distance between the rings 28*a* and 28*d* is found to be four feet, the distance between rings 28*a* and 28*b* is one foot, and the distance between rings 28*b* and 28*c* is two feet.

The foregoing is considered to have shown and described a preferred embodiment of this invention, it being understood that numerous modifications and changes in details of construction, combination and arrangement can be resorted to by those skilled in the art without departing from the scope of the invention as claimed.

What is claimed is:

1. An exercise apparatus for use in a swimming tank comprising
   a. a belt disposed about the waist of a swimmer;
   b. at least two rings coupled to said belt;
   c. a means coupled to said belt having at least two straps attached thereto for securing said means to said belt disposed about the waist of the swimmer for securing the position of said rings and for securing the position of said belt about the waist of the swimmer;
   d. at least two lines, each of which includes attaching means at the first and second ends thereof, the first ends of said lines being coupled to said rings on said belt; and
   e. a means for attaching the second ends of said lines to an edge of a swimming tank.

2. An exercise apparatus for use in a swimming tank comprising:
   a. a belt disposed about the waist of a swimmer;
   b. at least two rings coupled to said belt;
   c. a means coupled to said belt for securing the position of said rings and for securing the position of said belt about the waist of the swimmer;
   d. at least two lines, each of which includes attaching means at the first and second ends thereof, the first ends of said lines being coupled to said rings on said belt; and
   e. a strap having means at each end of said strap for attaching said strap to the edge of the swimming tank and the strap having attached thereto a plurality of second rings with the second ends of said lines coupled to the plurality of second rings.

3. An exercise apparatus as defined in claim 1 further characterized by the means at each end of said strap for attaching said strap to the edge of the swimming tank comprising a snap attached to each end of said strap and an attaching means with snap attached thereto secured to the edge of the swimming tank for coupling thereto the snaps located at the end of said strap.

* * * * *